US005283991A

United States Patent [19]

Keizers

[11] Patent Number: 5,283,991

[45] Date of Patent: Feb. 8, 1994

[54] SANDBLASTING METHOD AND A MOIST-SAND BLASTING APPARATUS

[76] Inventor: Josef Keizers, Konisberger Str. 2-4, D-4280 Borken/Westf., Fed. Rep. of Germany

[21] Appl. No.: 940,913

[22] Filed: Sep. 8, 1992

[51] Int. Cl.[5] ..... B24C 7/00

[52] U.S. Cl. ..... 51/438; 51/427; 51/436

[58] Field of Search ..... 51/317-321, 51/410, 427, 438, 263, 264, 439, 436, 292

[56] References Cited

U.S. PATENT DOCUMENTS

| | | | |
|---|---|---|---|
| 998,762 | 7/1911 | Faller | 51/439 |
| 2,543,517 | 2/1951 | Anderson | 51/439 |
| 4,689,923 | 9/1987 | Goudeaux | 51/410 |
| 4,709,515 | 12/1987 | Copeland | 51/438 |
| 4,951,428 | 8/1990 | Stromdahl | 51/436 |

*Primary Examiner*—Jack Lavinder

*Attorney, Agent, or Firm*—Kinney & Lange

[57] ABSTRACT

The invention relates to a sandblasting method using abrasives, such as untreated sands and in particular river and quarry sands, the abrasive and water being fed to a pressure tank (1*a*), a flowable water-abrasive mixture being produced in the pressure tank (1*a*) and this mixture being removed from the pressure tank (1*a*) and fed through a hose pipe (20) to a blast nozzle (21). The invention also relates to a moist-sand blasting apparatus (1). In order to provide a universally applicable sandblasting method and a corresponding apparatus, the invention permits water, compressed air and water-abrasive mixture to be fed to the hose pipe (20) via switch means (13, 15, 17) of a control unit (100) alternatively per se or in the combinations water and compressed air, water and water-abrasive mixture, compressed air and water, and water, compressed air and water-abrasive mixture.

8 Claims, 1 Drawing Sheet

SANDBLASTING METHOD AND A MOIST-SAND BLASTING APPARATUS

Figure 1:
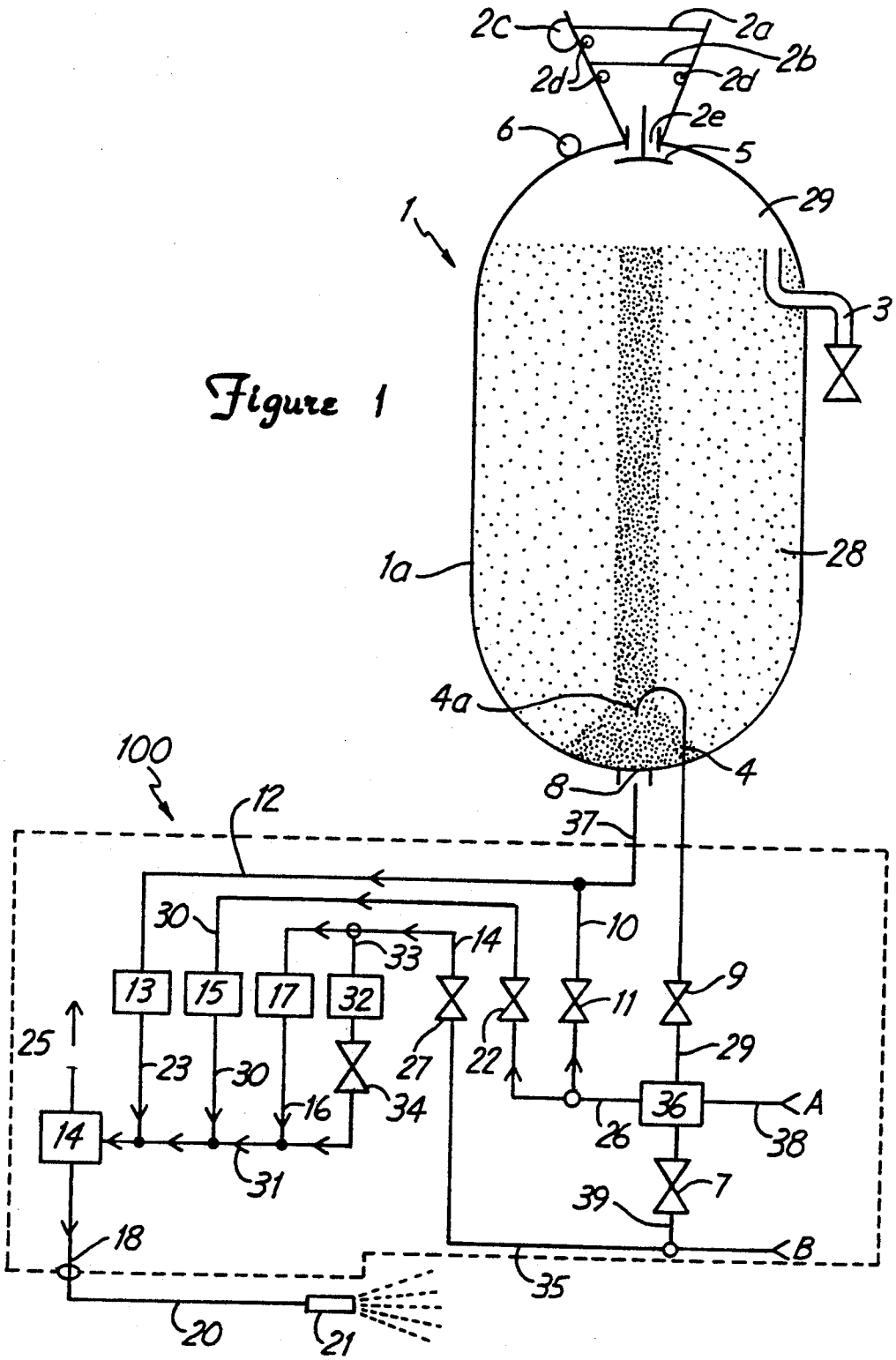

The present invention relates to a sandblasting method using abrasives, such as untreated sands and in particular river and quarry sands, the abrasive along with a constant stream of water being fed to a pressure tank to produce a flowable water-abrasive mixture in the pressure tank, this mixture being removed from the pressure tank and fed through a hose pipe to a blast nozzle.

The invention also relates to a moist-sand blasting apparatus preferably working by the above method. This known moist-sand blasting apparatus is provided with a feed means for the abrasive, a pressure tank into which the feed means opens through a feed opening, a water supply pipe into the pressure tank for producing a water-abrasive mixture, a discharge opening for removing the water-abrasive mixture from the pressure tank, and a hose pipe for feeding the water-abrasive mixture to a blast nozzle, with a connection for compressed air and a connection for water being provided.

Such a method and such a moist-sand blasting apparatus are known from European patent no. 0 122 928. This device yields very good blasting results, with a relatively low dust content during blasting and relatively little silting of the surroundings through the water content. However it has turned out in practice that the known moist-sand blaster is not universally applicable. It provides no possibility of blasting with only compressed air and water or with only compressed air. When such a blaster is used further apparatus are therefore always necessary for performing the various desired blasting operations, for example with only compressed air or with only compressed air and water.

German patent no. 924 075 describes a sandblasting apparatus which works either with compressed water or alternatively with compressed air and in which the overflow of the pressure chamber is connected with the mixture pipe via a special pipe. However the flow through this pipe cannot be regulated. Furthermore this known apparatus does not permit blasting with only compressed air in so-called "water operation" or with only water in so-called "compressed-air operation."

It is also known from German "offenlegungsschrift" no. 18 09 678 to feed water, for example, to the blast gun through a separate hose pipe along with the blast mixture. However this embodiment has the considerable disadvantage that two hoses might have to be carried over 100 m. The danger of leaks is of course great in such cases.

German patent no. 40 12 435 discloses an apparatus in which it appears to be fundamentally possible to adjust various mixtures of compressed air, water and water-abrasive mixture for blasting via manually operated stoppers. However this known apparatus works with a limited water reservoir so that a washing operation using a large amount of water can only be performed for a short time. The pressure chamber must then be filled with water again. This device seems un-suitable for continuous blasting operation. Furthermore the manual setting of the various possiblities available for sandblasting is very troublesome for the operator, in particular when the sandblasting apparatus is 100 m away from the surface to be blasted, for example.

The invention is based on the problem of providing and developing a method and a sandblasting apparatus of the aforesaid type which offer a multiplicity of blasting posibilities for sandblasting.

This problem is solved by the inventive method in that water, compressed air and the water-abrasive mixture can be fed to the hose pipe via controllable switch means of a control unit alternatively, i.e. per se or in the combinations water and compressed air, water and water-abrasive mixture, compressed air and water, and water, compressed air and water-abrasive mixture. The invention thus provides a method which permits the components water, compressed air and water-abrasive mixture to be fed in all variations.

It is particularly expedient if the amounts and pressures of water and compressed air are singly controllable via quantity governors. This makes it possible to produce an optimal blasting result for each case of application. For example, if a surface is to be blasted requiring a high water content and low aggressiveness of the abrasive, blasting is performed with very little or no compressed air and the water content in the water-abrasive mixture is increased after the mixture leaves the pressure tank.

If one or more liquids can additionally be added during blasting and the amount of liquid is controllable in each case, oxidization of blasted metal surfaces can be avoided by adding an inhibitor or a preserving liquid for example. It is expedient if this liquid or these liquids are added in metered fashion via the compressed-air stream.

The inventive method is particularly easy to operate if the quantity governors and/or switch means are remote-controlled. The remote control works by the known, customary methods. The switch means are expediently controlled pneumatically. This means that a receiving means is first provided for receiving the signal given via the remote-control unit and opening a corresponding valve. Compressed air then flows through the valve, in turn acting upon the corresponding switch unit and opening it. If a further signal is now given to the receiver of the particular control unit via the remote-control unit, the corresponding valve is closed again and the switch unit depressurized so that it closes.

Remote control is particularly advantageous when the switch means and/or quantity governors are located some distance away from the surface to be blasted, so that the operator can readily and easily adjust the various blasting possibilities when he is at the blast nozzle.

It has also proven particularly advantageous if the water-abrasive mixture leaves the pressure tank in a mixture ratio of about 20 vol. % water to about 80 vol. % sand. This obtains a flowable paste of the mixture with a relatively low water content so that silting of the surroundings need not be feared.

To achieve the inventive effects the moist-sand blasting apparatus has a control unit provided in the direction of flow of the water-abrasive mixture between the discharge opening and the hose pipe. This control unit, that can be mounted for example directly on the blasting chamber, has a first switch means for the water-abrasive mixture, a second switch means only for water, and a third switch means only for compressed air. The switch units are each separately controllable. The first switch means is connected with the discharge opening via a mixture pipe, while the second switch means for water is connected with the external water connection via a water pipe, and the third switch means for compressed air with the compressed-air connection via a compressed-air pipe. The outputs of the switch means are connected in turn with a common pipe which passes into the hose pipe. This special constructional design of the control unit permits the operator to adjust all possibilities for blasting water-abrasive mixture, water and compressed air merely by starting or stopping various switch units. This device is thus universally applicable without requiring any further machines or means for blasting. Furthermore only one hose pipe is necessary so that there are no additional pipes which carry compressed air and water, for example, and might be damaged.

In another embodiment of the invention the switch units have only the "open" position and the "closed" position. Since the amount and pressure of the water and the compressed air cannot be controlled via the switch units in this embodiment example, quantity governors for controlling amount and pressure are provided in the compressed-air pipe to the third switch means and in the water pipe to the second switch means.

To permit the water-abrasive mixture delivered from the pressure tank to be enriched additionally with water, the water pipe is also connected with the mixture pipe via a connecting pipe and a quantity governor for controlling amount and pressure is provided in the mixture pipe.

Special advantages result for operation of the inventive moist-sand blasting apparatus when a fast-stop switch means is provided in the common pipe. This means is inventively designed such that passage through the common pipe remains free in every position of the switch means, and the opening of the switch means unblocks an opening and/or a further pipe with a larger cross section than the common pipe.

This fast-stop switch means allows the pressure prevailing in the hose pipe to escape and drop to 0 very quickly via the opening and/or the further pipe after the end of blasting. This reduces the afterflow time at the blast nozzle from over 30 sec to about 3 sec with a blast hose 100 m long, for example. It is particularly expedient to design the fast-stop switch means such that it opens when the first to third switch means are closed, and vice versa. The closed position of the first to third switch means signifies that the device is not in operation. Thus, when the first to third switch means are all in this position the fast-stop switch means can open and unblock the enlarged cross section for pressure reduction.

It is frequently necessary to preserve the blasted surface after the blasting operation proper or, if it is a metal surface, to protect it from oxidation. The invention thus provides for a container for liquid to be connected with the compressed-air connection via a further compressed-air pipe, said container being connected with the common pipe, and a quantity governor being provided in the direction of flow after the container.

Further advantageous embodiments of the invention have a quantity governor provided in the water supply pipe to the pressure tank so that the amount of water and ultimately also the water-abrasive mixture can already be adjusted at this point. To increase the pressure of the amount of water fed to the pressure tank, the compressed-air pipe is also connected with the water supply pipe of the pressure tank via a further connecting pipe, a quantity governor being provided in the connecting pipe for switching off the compressed air. This quantity governor is provided in case a pressure increase in the water fed to the pressure tank is unnecessary.

Reference was already made above to the technical handling advantages of remote control for the switch means and/or the quantity governors. A remote-control unit is expediently provided for the switch means and/or the quantity governors on, or in the area of, the blast nozzle so that the operator can easily adjust and control the blasting mixture when he is at the working place.

Further features, advantages, goals and possibilities of application of the present invention can be seen in the following description of an embodiment example with reference to the drawing. All features described or shown in the figure form the object of the invention per se or in any combination.

FIG. 1 shows a schematic representation of the inventive moist-sand blasting apparatus.

Moist-sand blasting apparatus 1 has a pressure tank 1*a* provided with a feed means 2. This may be for example a screen attachment with a coarse screen 2*a* and a fine screen 2*b*, with a vibrator 2*c* also being disposed on the screen attachment to support screening, and water nozzles 2*d* below screens 2*a*, 2*b* which point toward the screen surfaces of screens 2*a*, 2*b* thereby improving the screening result.

Conventional abrasive, i.e. abrasive of a given size range as is directly available from the dealer for example, or else moist untreated soils and sands such as river and quarry sand, can be fed through feed means 2. If moist or untreated sands are fed the feed means is set vibrating by vibrator 2*c* with water being added either via nozzles 2*d* or via a ring conduit (not shown) in order to accelerate the feed of the sand through feed means 2. After passing through screens 2*a*, 2*b* the abrasive falls through the lower funnel-shaped area of the feed means into pressure chamber 1*a* via an opening 2*e*.

Pressure chamber 1*a* also has an overflow 3 and a water supply pipe 4. Opening 2*e* can be sealed by a stopper 5 that can be formed as a float for example. Chamber 1*a* also has a pressure safety valve 6 which opens if a given maximum pressure is exceeded. An outlet 8 is provided for discharging the mixed abrasive into a pipe 37.

If an abrasive or moist untreated sand is now fed via feed means 2 through opening 2*e* into pressure tank 1*a* the latter fills up to its upper edge or, in the embodiment shown, up to overflow 3. At the same time water is fed in small amounts via pipe 4. At the end of pipe 4 there is a nozzle 4*a* which feeds water constantly to the pressure tank. In the embodiment example shown the water rises slowly through the sand, which has greater specific gravity than water, and fills the space marked 29. Since stopper 5 is designed as a float it seals opening 2*e* at a corresponding water level. A suitable pressure can now build up in the chamber.

Moist-sand blasting apparatus 1 also has a control unit referred to altogether as 100. This control unit, shown by broken lines, is generally stationary on, or in the area of pressure chamber 1*a*. Control unit 100 is provided with a water connection A and a compressed-air connection B for a compressor. Water connection A is connected to a pipe 38 that opens into a pressure increasing means 36. Pressure increasing means 36 is in turn connected with the three pipes 24, 26 and 39, pipe 24 being controllable via a quantity governor for compressed water. The amount of compressed water, or its pressure, is produced by pressure increasing means 36, that is controlled with air pressure via pipe 39 and valve 7, and conducted via pipe 24 to pressure tank 1*a*. If a water connection with sufficient pressure is present in the case of application, pressure increasing means 36 can be stopped. In this case valve 7 is closed. If the water pressure is insufficient compressed air is fed via pipe 39 to pressure increasing means 36, thereby increasing the pressure in pipe 24 or 4.

Pipe 26 for the compressed water branches into a water pipe 30 and a connecting pipe 10. Connecting pipe 10, that is adjustable via a quantity governor 11, opens into mixture pipe 37 coming from pressure tank 1*a*. The mixed abrasive delivered from pressure tank 1*a* can be additionally enriched with water through connecting pipe 10. The water-abrasive-water mixture conditioned in this way is then conducted via mixture pipe 12, that is connected to pipe 37, to a first switch means 13. First switch means 13 is designed such that only the "on" or "off" position is possible.

Water pipe 30, that likewise contains a quantity governor 22, leads to a second switch means 15 which likewise permits only the "on" or "off" position.

Along with the compressed-air supply of water supply pipe 4 via pipe 39, a compressed-air pipe 35 is provided for compressed-air supply that is connected with compressed-air connection B. A quantity governor 27 is inserted in compressed-air pipe 35 before pipe 35 branches into pipes 33 and 16. While pipe 16 leads into a third switch means for compressed air 17, that likewise permits only the "on" and "off" positions, pipe 33 leads into a store tank for a liquid to be Injected. A quantity governor 34 is connected to pipe 33.

Pipes 33, 16, 30 and 23 pass into a common pipe 31 which opens into a switch means 19. Switch means 19 is a so-called "fast-stop" switch means that is constructed such that the stream conducted through pipe 31 can readily pass it and pour into a pipe 18 in the closed position of switch means 19. Switch means 13, 15, 17, on the one hand, and 19, on the other hand, are switched such that when switch means 13, 15, 17 are open switch means 19 is closed, and vice versa. If switch means 13, 15, 17 are closed, switch means 19 opens immediately, unblocking pipe 25 that has a large cross section compared to pipe 18.

Pipe 18 for the working medium is connected to a hose 20 with a blast nozzle 21.

Control unit 100 is designed such that switch means 13, 15 and 17 and switch means 19 as well as quantity governors 7, 9, 11, 22, 27 can be operated by remote control.

Feeding and blasting operation takes place in inventive moist-sand blasting apparatus 1 as follows.

Feed pipe 4 is designed in pressure chamber 1*a* such that only a water jet emerges from nozzle 4*a* of pipe 4 and this jet is directed so as to point toward outlet 8. Feed pipe 4 is supplied with compressed water via pipe 24. Water also already emerges constantly from pipe 4 during the feeding process in order to prevent the nozzle and the pipe from clogging. During feeding and blasting the inflowing water from pipe 4 loosens sand 28 lying hardpacked in the tank in the area of outlet 8, producing a flowable paste comprising about 80 vol. % sand and about 20 vol. % water. The amount of compressed water flowing from pipe 4 into pressure chamber 1*a* is controlled by metering valve 9 and corresponds to the amount of mixture of 80 vol. % sand and 20 vol. % water that is to be transported to nozzle 21 during the blasting operation with sand, water and compressed air via pipe 31 and blast hose 20. Since water is lighter than abrasive or sand, the rest of the supplied water (80 vol. %) rises into the upper area of pressure chamber 1*a*, that is marked 29, letting the sand slide down from the upper container area.

Blasting is started via switch means 17, i.e. via pipes 14, 16, 31, 18. Although blasting can take place only via switch means 13 with switch means 15 and 17 closed, the blasting power is very limited in this case since it depends only on the water pressure. The so-called aggressiveness of the mixed abrasive can be regulated via switch means 17. The higher the pressure of the compressed air with switch means 13 and 17 open, the higher the blasting power and thus the aggressiveness of the abrasive. The amount of compressed air can be adjusted via metering valve 27. However the aggressiveness also determines the water pressure indirectly via pipe 39, and thus also the tank pressure in pressure chamber 1*a* during blasting. During blasting the tank pressure is about 0.5 bars higher than the working pressure. The slightly higher pressure is pressure tank 1*a* and thus also in pipe 12 compared to the working pressure in pipe 10 or 16 causes the adjusted mixed abrasive to be urged through pipe 23 into pipe 31 and conducted via pipe 31 to the blast nozzle.

If the water content is to be increased during blasting water is added in metered fashion to pipe 12 or 37 via pipe 10 and valve 11. If the water content is to be increased to 100%, i.e. no sand is to be used, switching means 15 and 17 are adjusted to the desired pressure or amount and switch means 13 and 19 closed. Switch means 15 is supplied via water pipe 30 that is connected to pressure increasing means 36. The amount of water is controlled via valve 22.

An additional liquid (e.g. hardener, rust preventer) can be added to the air stream via pipe 31 through store tank 32, that is subjected to the working pressure from pipe 14 via pipe 33. The added amounts are controllable via valve 34. If several liquids or different liquids in different concentrations must be added it is of course possible to connect more than one store tank by the same pattern.

To end blasting, switch means 13, 15 and 17 are closed, whereupon switch means 19, which works in the opposite direction, opens. The opening of switch means 19 causes the pressure prevailing in blast hose 20 and pipe 18 to escape extremely fast via pipe 25 and drop to 0. The fast pressure reduction in blast pipe 20 is obtained by a larger cross section in pipe 25 and switch means 19. Fast-stop switch means 19, which works dependently and in the opposite direction to switch means 13, 15 and 17, permits the afterflow time at the blast nozzle to be reduced from over 30 sec to about 3 sec with a blast hose 100 m long, for example.

I claim:

1. A moist-sand blasting apparatus having a feed means for the abrasive, a pressure tank into which the feed means opens through a feed opening, a water supply pipe to the pressure tank for producing a water-abrasive mixture, a discharge opening for removing the water-abrasive mixture from the pressure tank, and a hose pipe for feeding the water-abrasive mixture to a blast nozzle, with a connection for compressed air and a connection for water being provided, characterized in that a control unit is provided between the discharge opening and the hose pipe, said control unit having a first switch means for the water-abrasive mixture, a second switch means for water and a third switch means for compressed air, the switch units being separately controllable, and the first switch means for the water-abrasive mixture being connected with the discharge opening via a mixture pipe, the second switch means for water being connected with the water connection via a water pipe, and the third switch means for compressed air being connected with the compressed-air connection via a compressed-air pipe, the outputs of the switch units being connected to a fast-stop switch means which is connected with a common pipe which is in turn connected with the hose pipe, and the fast-stop switch means is designed such that it opens when the first to third switch means are closed in order to quickly reduce the pressure in the hose pipe and blast nozzle.

2. The moist-sand blasting apparatus of claim 1, characterized in that the switch means have only the "open" position and the "closed" position, and quantity governors for quantity and pressure control are provided in the compressed-air pipe to the third switch means and in the water pipe to the second switch means.

3. The moist-sand blasting apparatus of claim 1, characterized in that the water pipe is connected with the mixture pipe via a connecting pipe, and a quantity governor for quantity and pressure control is provided in the connecting pipe.

4. The moist-sand blasting apparatus claim 1, characterized in that a container for liquid is connected with the compressed-air connection via a further compressed-air pipe, said container being connected with the common pipe, and a quantity governor being provided in the direction of flow after the container.

5. The moist-sand blasting apparatus of claim 1, characterized in that a quantity governor is provided in the water supply pipe.

6. The moist-sand blasting apparatus of claim 1, characterized in that the compressed-air pipe is connected with the water supply pipe of the pressure tank via a further connecting pipe, a quantity governor being provided in the further connecting pipe.

7. The moist-sand blasting apparatus of claim 1, characterized in that the switch means and the quantity governors are remote-controllable.

8. The moist-sand blasting apparatus of claim 7, characterized in that a remote-control unit for the switch means and the quantity governors is provided on or in the area of the blast nozzle.

* * * * *

UNITED STATES PATENT AND TRADEMARK OFFICE

CERTIFICATE OF CORRECTION

PATENT NO. : 5,283,991

DATED : February 8, 1994

INVENTOR(S) : JOSEF KEIZERS

It is certified that error appears in the above-identified patent and that said Letters Patent is hereby corrected as shown below:

On the Title Page of the Patent, in the References Cited section, add the following:

| | | |
|---|---|---|
| 924075 | 2/1955 | Germany |
| 1809678 | 11/1968 | Germany |
| 122928 | 1/1989 | Germany |
| 4012435 | 4/1990 | Germany |

Signed and Sealed this

Fourteenth Day of June, 1994

Bruce Lehman

*Attest:*

BRUCE LEHMAN

*Attesting Officer*

*Commissioner of Patents and Trademarks*